United States Patent [19]

Metz

[11] Patent Number: 4,773,641

[45] Date of Patent: Sep. 27, 1988

[54] YIELDABLE RESTRAINING MEMBERS FOR BARBELL WEIGHTS

[76] Inventor: Charles L. Metz, R.R.#9 - Box 683A, Greensburg, Pa. 15601

[21] Appl. No.: 15,737

[22] Filed: Feb. 17, 1987

[51] Int. Cl.[4] ..... A63B 13/00

[52] U.S. Cl. ..... 272/123; 24/671; 403/372

[58] Field of Search ..... 272/117, 122, 123, 124, 272/81.2; 24/662, 664, 671, 672; 403/351, 372

[56] References Cited

U.S. PATENT DOCUMENTS

| | | | |
|---|---|---|---|
| 1,716,462 | 6/1929 | Reiter | 24/671 |
| 3,606,410 | 9/1971 | Inserra | 273/81.2 X |
| 3,747,964 | 7/1973 | Nilsen | 273/81.2 X |
| 4,195,944 | 4/1980 | Cross | 403/372 X |
| 4,455,020 | 6/1984 | Schnell | 272/123 |
| 4,543,695 | 10/1985 | Dorsey | 24/671 X |
| 4,569,105 | 2/1986 | Deider | 272/123 X |

FOREIGN PATENT DOCUMENTS

| | | | |
|---|---|---|---|
| 1118952 | 3/1956 | France | 403/351 |
| 734437 | 5/1980 | U.S.S.R. | 403/351 |
| 2156229 | 10/1985 | United Kingdom | 272/123 |

*Primary Examiner*—Richard J. Apley
*Assistant Examiner*—Robert D. Bahr
*Attorney, Agent, or Firm*—Clifford A. Poff; Thomas H. Murray

[57] ABSTRACT

Collars are provided for yieldingly restraining weights from leaving the ends of a barbell. Each collar surrounds the barbell shaft and contains a set of grooves which receive snugly O-rings made of resilient material. In the unstressed condition of each O-ring, the interior diameter is less than that of the barbell shaft. Preferably, the grooves have a generally square or trapezoidal cross-section, with a slightly widened mouth. A part of the collar can be gripped with the fingers to remove friction-platelock collars from the barbell.

5 Claims, 1 Drawing Sheet

YIELDABLE RESTRAINING MEMBERS FOR BARBELL WEIGHTS

BACKGROUND OF THE INVENTION

1. Field of the Invention

This invention relates to barbell equipment, and in particular, it relates to providing, in connection with such equipment, means for restraining, in a novel way and to a novel extent, the weights on a barbell against the falling from the ends thereof.

2. Description of the Prior Art

There is, of course, nothing new about the broad concept of providing, in the vicinities of the ends of a barbell, a means which has the effect of preventing the weights of the barbell from falling from the ends thereof.

In the case of Olympic weight-lifting, the usual actual practice is not to provide any mechanical constraint; unless weight lifter desires to use a device to keep weights on any remedial action in the direction of preventing any of the weights from leaving its end of the barbell is done by hand, by an attentive person, a spotter, who observes the weight-lifting operation.

In the case of non-Olympic weightlifting, it be taken as being already known that there may be used such known means as a collar and a setscrew which passes therethrough and bears upon the barbell or an internally threaded cap which can be screwed onto a matching externally threaded boss.

It has been found that there are purposes for which it is desirable to provide restraining means that will operate, and for the above purpose, but especially in what may be termed "a semi-secure manner", such that the means serves in most circumstances securely to prevent a weight from falling from its end of a barbell, while at the same time, the means is of such a nature that the structure possesses a capability of causing a weight to be released by tilting barbell to one side thereby causing the weights to push the locks off, even without the intervention of any attendant or spotter, i.e., while the person holding the barbell is keeping both of his hands thereon. The occasion for desiring to obtain an action of this sort sometimes arises, for example, while the bodybuilder is lying on his back, having taken the loaded barbell from a support rack located above his chest or neck. The occasion arises in which he is neither able to restore the barbell to its rack without help nor able to set it down without injuring himself. For the purpose of dealing with this situation, no attendant being at hand, it is desirable to have a "semi-secure" weight-retaining means, one which will yieldingly permit a weight to leave one end of the bar, without requiring the bodybuilder or an attendant to intervene and loosen something, while providing ordinarily enough support to insure that the weight remains in its place.

The known prior-art structures or means for keeping the weights on the bar do not provide any such effect. Such effect is not obtained with an end cap screwed to the bar (see U.S. Pat. No. 1,536,048) or with a collar that has a setscrew passing through it which bears on the bar.

SUMMARY OF THE INVENTION

A suitable means for yieldingly restraining weights from leaving their ends of a barbell is provided, with the use of a collar which surrounds the barbell shaft and contains a set of grooves which receive snugly a set of O-rings which are of resilient material and have in their unstressed condition an interior diameter less than that of the barbell shaft. Preferably, the grooves have a generally square or trapezoidal cross-section, with a slightly widened mouth.

DESCRIPTION OF THE DRAWINGS

A complete understanding of the invention may be obtained from the foregoing and following description thereof, taken in conjunction with the appended drawings, in which.

DESCRIPTION OF THE PREFERRED EMBODIMENTS

Figure 1:
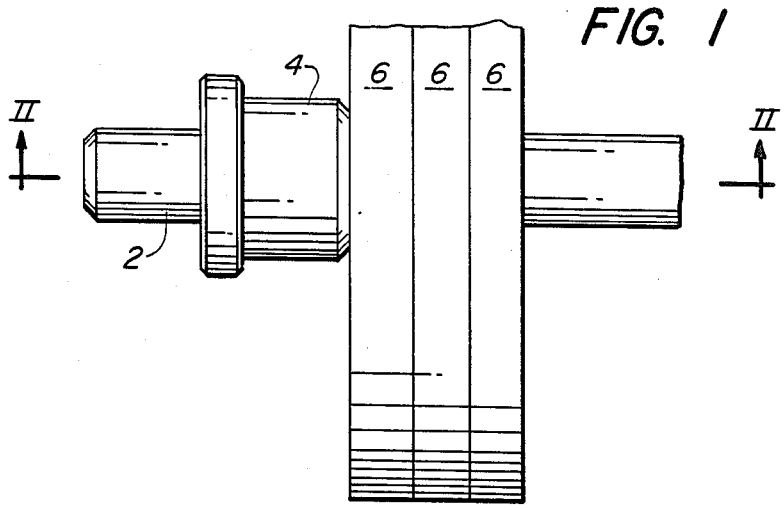
FIG. 1 represents a plan view of one end of a barbell, provided with equipment in accordance with the present invention.

Referring to the drawings, and in particular to FIG. 1, there is shown in plan view an end 2 of a barbell, having mounted thereon a friction-lock collar 4 in accordance with the invention, which is used to restrain a plurality of weights 6, which are also mounted on the barbell shaft 2.

Figure 2:
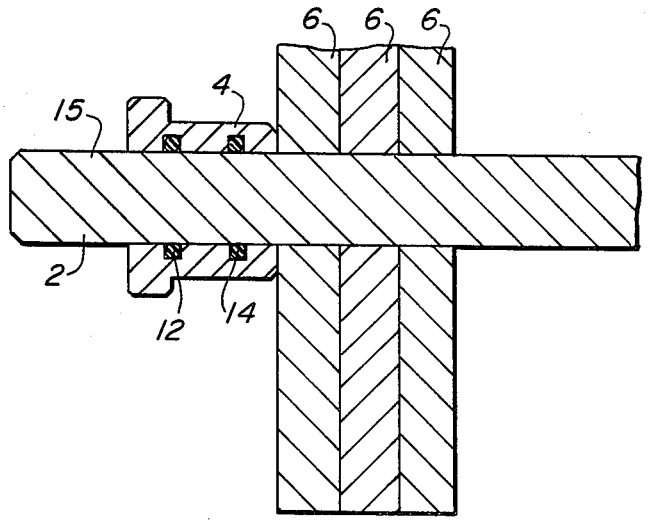
FIG. 2 is a sectional view, taken on the line II—II of FIG. 1.
Figure 3:
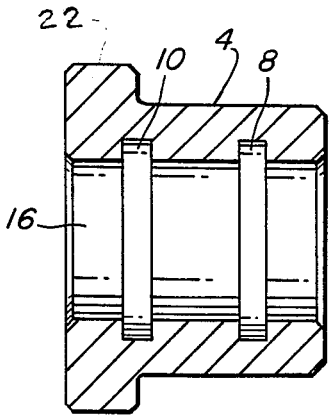
FIG. 3 is a sectional view, similar to FIG. 2, of a friction-platelock collar in accordance with the present invention, on a somewhat enlarged scale.

As can better be seen in FIGS. 2 and 3, in the practice of the invention, the desired "semi-secure" restraining action is obtained by providing a friction-platelock collar 4 having a set of spaced-apart annular grooves 8, 10, within which there are received a set of O-ring members 12, 14, which are made of suitable resilient material. It is to be understood that the O-rings are of such nature that they have an interior diameter which is, when the O-ring is in its unstressed condition, suitably slightly less than the diameter of the shaft 15 of the barbell. For example, when the shaft 15 has a diameter of 1 inch, which is usual in the case of barbells in connection with non-Olympic weightlifting, the O-rings 12, 14 may have an interior diameter of 15/16 inch, as well as other suitable corresponding dimensions, such as an outside diameter of $1\frac{3}{8}$ inches and a wall 3/16 inch thick. One relatively wide O-ring can be used instead of two O-rings if desired.

The friction-platelock collar 4, as can be seen from FIG. 3, contains a central bore 16, which is of a suitable diameter to permit the shaft 15 to pass therethrough. For an appropriate sliding fit, there may be used a bore 16 having an interior diameter of approximately 1.005 inch, for a shaft 15 having a diameter of 1 inch. As best seen in FIG. 3, the friction-platelock collar 4 is provided with an enlarged flange section 22 to facilitate removal of the collar 4 from the barbell by the fingers of the user.

Figure 4:
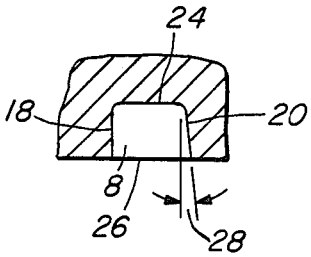
FIG. 4 is a detail sectional view of a portion of the structure shown in FIG. 3.

As shown in FIG. 4, the friction-platelock collar 4 has a set of spaced-apart annular grooves 8 and 10, which are of such nature as to be approximately square or trapezoidal in cross section, with straight sides 18 and 20 and a straight bottom 24, which is opposite the mouth 26 of the groove 8.

Preferably, the side 20, which is the side more remote from the end of the shaft 15, rather than being perpendicular to the axis of the shaft 15, is at a small angle, of 1 to 5 degrees, with respect thereto. The angled sides of the grooves provide expansion pockets to allow for elastic expansion of the O-rings.

While I have shown and described herein certain embodiments of my invention, I intend to cover as well any change or modification therein which may be made without departing from its spirit and scope.

I claim as my invention:

1. The combination of a barbell shaft, a weight and apparatus for yieldingly securing the weight against falling from an end of said barbell shaft, said apparatus comprising:

a set of O-rings of resilient material having in their unstressed condition an interior diameter less than that of the barbell shaft, and a friction-platelock collar member adapted to surround said barbell shaft and having therein a bore for the passage of said barbell shaft therethrough, said friction-platelock member having therein a set of spaced annular grooves which are of such dimensions as to receive snugly said O-rings when they are in an as-stressed condition from having been caused to surround said shaft of said barbell.

2. Apparatus as defined in claim 1, wherein said grooves in said friction-platelock collar member possess in cross section an outline which is approximately a square, with rounded corners, said groove having straight-sided sides and a straight-sided bottom, with the one of said sides which is more remote from the end of the barbell being at an angle of 1 to 5 degrees with respect to a plane perpendicular to the axis of said shaft of said barbell and passing through the location where the said side intersects with the said bottom, said angle being in such sense that the mouth of said groove is widened, in comparison with having the sides of said grooves located in planes perpendicular to said axis of said barbell.

3. In a barbell including a weight removably received on a barbell shaft, the combination thereof and an apparatus for yieldingly securing the weight against falling from an end of the barbell shaft, said apparatus comprising:

at least one endless annular resilient member having in its unstressed condition an interior opening less than that of the cross-section of the barbell shaft, and a friction-platelock collar member adapted to surround said barbell shaft and having therein a bore for the passage of said barbell shaft therethrough, said friction-platelock member having therein at least one groove which is of such dimensions as to retain said member of resilient material in an as-stressed condition when engaged with said shaft of said barbell.

4. Apparatus as defined in claim 3, wherein said groove in said friction-platelock collar member possess in cross section an outline which is approximately a square, with rounded corners, said groove having straight-sided sides and a straight-sided bottom, with the one of said sides which is more remote from the end of the barbell being at an angle of 1 to 5 degrees with respect to a plane perpendicular to the axis of said shaft of said barbell and passing through the location where the said side intersects with the said bottom, said angle being in such sense that the mouth of said groove is widened, in comparison with having the sides of said grooves located in planes perpendicular to said axis of said barbell.

5. Apparatus as defined in claim 3 for yieldingly securing a weight against falling from an end of a barbell, said apparatus comprising:

a set of means of resilient material having in their unstressed condition an interior opening less than that of the cross section of the barbell shaft, and a friction-platelock collar member adapted to surround said barbell shaft and having therein a bore for the passage of said barbell shaft therethrough, said friction-platelock member having therein a set of spaced annular grooves which are of such dimensions as to support said means of resilient material when they are in an as-stressed condition from having been caused to surround said shaft of said barbell.

* * * * *